US005944126A

United States Patent [19]

Brolund

[11] Patent Number: 5,944,126

[45] Date of Patent: Aug. 31, 1999

[54] RESILIENT, NON-ROTATING SEAL FOR ROCK DRILL

[75] Inventor: Stig-Åke Brolund, Houston, Tex.

[73] Assignee: Sandvik AB, Sandviken, Sweden

[21] Appl. No.: 08/947,026

[22] Filed: Oct. 8, 1997

[30] Foreign Application Priority Data

Oct. 8, 1996 [SE] Sweden ..... 9603663

[51] Int. Cl.[6] ..... E21B 10/22

[52] U.S. Cl. ..... 175/371

[58] Field of Search ..... 175/359, 371, 175/372

[56] References Cited

U.S. PATENT DOCUMENTS

| | | | |
|---|---|---|---|
| 3,489,421 | 1/1970 | Neilson | 277/383 |
| 3,663,073 | 5/1972 | Bronson | 384/93 |
| 3,680,873 | 8/1972 | Garner | 277/376 |
| 4,306,727 | 12/1981 | Deane et al. | 277/12 |
| 4,560,175 | 12/1985 | Kar et al. | 175/371 |
| 4,722,404 | 2/1988 | Evans | 175/371 |
| 5,295,549 | 3/1994 | Dolezal et al. | 175/371 |

*Primary Examiner*—William Neuder
*Assistant Examiner*—John J. Kreck
*Attorney, Agent, or Firm*—Burns, Doane, Swecker & Mathis, L.L.P.

[57] ABSTRACT

A rock drill bit includes at least one leg about which a roller cutter is rotatably mounted. A ring-shaped seal is disposed between an end surface of the leg and a sealing surface of the roller cutter. The seal is arranged coaxially with respect to an axis of rotation of the roller cutter and is formed of an elastic material and a relatively rigid material embedded within the elastic material. The elastic material defines first and second surfaces which engage the leg and the roller cutter, respectively. Either the leg or the seal includes circumferentially spaced recesses which receive respective projections formed in the other of the leg and the seal, for locking the seal to the leg against rotation relative thereto.

4 Claims, 4 Drawing Sheets

RESILIENT, NON-ROTATING SEAL FOR ROCK DRILL

BACKGROUND OF THE INVENTION

The present invention relates to a rock drill bit for rotary crushing machining of rock, including at least a leg carrying a bearing journal provided with bearing surfaces in order to cooperate with races via bearing elements in a thereby rotatable roller cutter equipped with a crushing organ, the leg comprising a tail and seal means intended to counteract entrance of drill cuttings into the bearings, the seal means furthermore being intended to retain bearing grease; the seal means being concentrically provided around the bearing journal and being intended to slide against the roller cutter.

PRIOR ART

An example of a rotary drill bit of the above-mentioned type is disclosed in U.S. Pat. No. 5,295,549. The known tool comprises an axially movable seal, having two metallic rings sealed against the roller cutter and the bearing journal via radially compressed rubber rings. The metallic rings rotate relative to each other and abut against each other via polished abutment surfaces. The known tool has five possible places for leakage of drill cuttings to the bearings. Furthermore, the known seal is troublesome to assemble since it contains a plurality of components. In addition oblique positioning of the abutment surfaces is risked since the seal does not have any rebound in the axial direction between the leg and the roller cutter. Further examples of seals held lby friction and/or gluing are disclosed in U.S. Pat. Nos. 3,663,073; 4,560,175 and 4,722,404. U.S. Pat. No. 3,489,421 discloses a seal press-fitted about the journal and deformed after positioning for retaining the position of the seal.

SUMMARY OF THE INVENTION

One object of the present invention is to provide a rotary drilling bit in which a life-span of the bearings may be extended considerably compared to crowns with conventional seals.

Another object of the present invention is to provide a rotary drilling bit in which a mounting of the seal means is simplified considerably compared to crowns with conventional seals.

Another object of the present invention is to provide a rotary drilling bit and a seal means, which provides for an exact and safe location of the seal means Another object of the present invention is to provide a sealing ring, which has a good resistance against abrasion.

BRIEF DESCRIPTION OF THE DRAWINGS

The objects and advantages of the invention will become apparent from the following detailed description of a preferred embodiment thereof in connection with the accompanying drawing in which like numerals designate like elements, and in which.

DETAILED DESCRIPTION OF A PREFERRED EMBODIMENT OF THE INVENTION

Figure 1A:
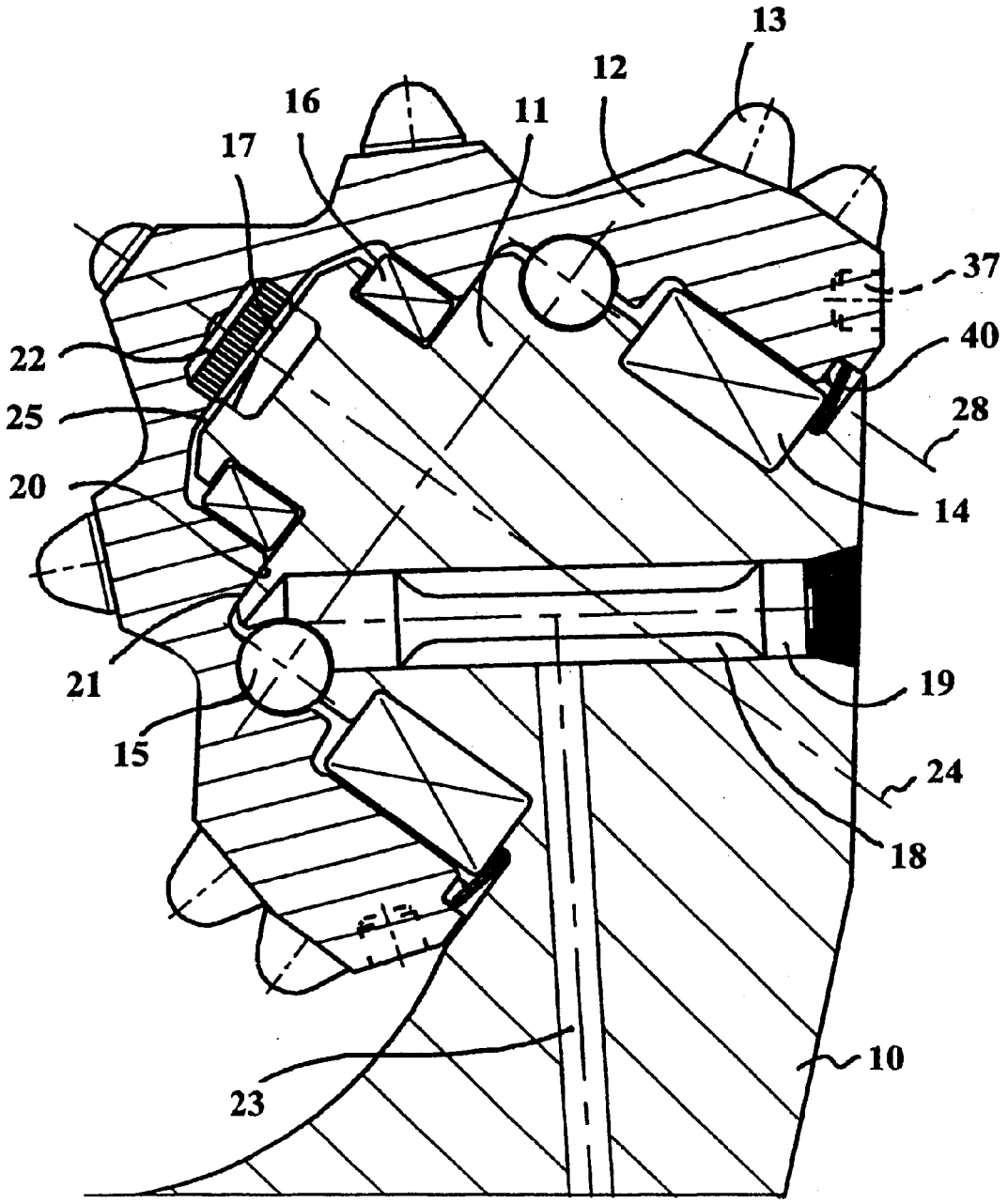
FIG. 1A shows a leg and a roller cutter of a rotary drilling bit according to the present invention, in cross section.
Figure 1B:
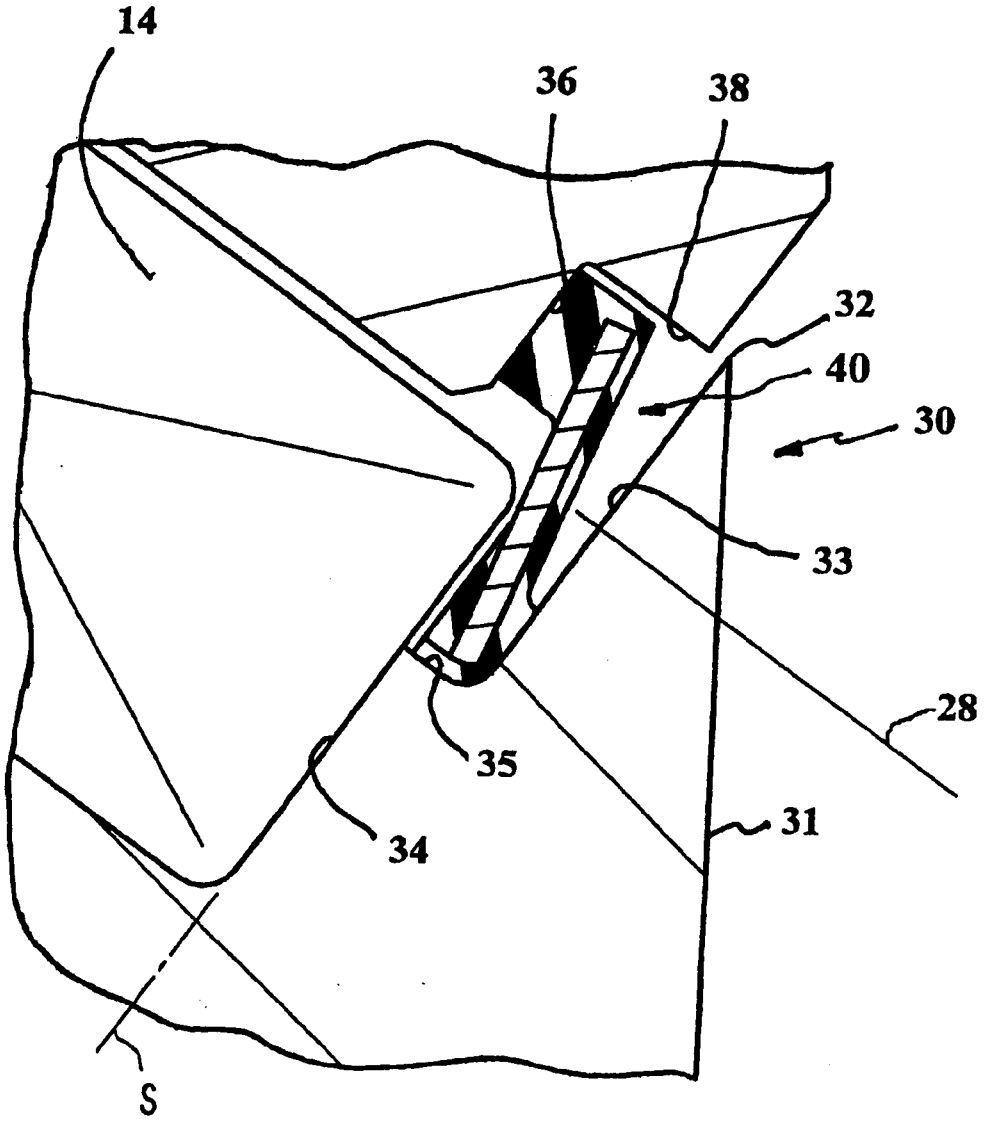
FIG. 1B shows an enlarged part of the rotary drilling bit according to FIG. 1A.

With reference to FIGS. 1A and 1B there is shown a rock drill bit according to the present invention, for rotary crushing drilling of rock, a so called rotary drill bit. The drill bit preferably comprises three legs, whereof one sectioned leg 10 is shown. A bearing journal 11 is formed on the leg. In certain designs of drill bits it is possible to provide only one or two legs. On each bearing journal is a roller cutter 12 provided, with buttons 13, rotatably journalled by a cylinder bearing 14, a system of roller bearing balls 15, a radial bearing 16 as well as an axial bearing 17. The buttons can alternatively be replaced by other crushing organs, such as chisels or teeth integrated with the roller cutter. The legs 11 are evenly distributed around the circumference of the drill bit with 120° partition. For the adoption of roller bearing balls 15 the bearing journal 11 is provided with a channel 18, in which a peg 19 is received in order to retain the balls 15. The cylindrical cylinder bearing 14 receives a large part of the force of reaction from the rock, while the principal task of the roller bearing balls 15 is to retain the roller cutter 12 on the leg 11. The roller cutter has a shoulder 20 that is brought against a collar 21 on the leg for taking up any axial forces which are not taken up by the cooperation of a support surface 22 with the axial end surface 25 of the shank. The above mentioned bearings are sealed and lubricated by a lubricating system integrated with the drill bit. The lubricating system is connected with the bearing system by means of the channel 23. Instead of the cylinder bearing 14 a slide bearing can be arranged substantially at the corresponding position. The bearing journal 11 has a central line 24 around which the roller cutter 12 and the bearings 14, 15 rotate.

Figure 2:
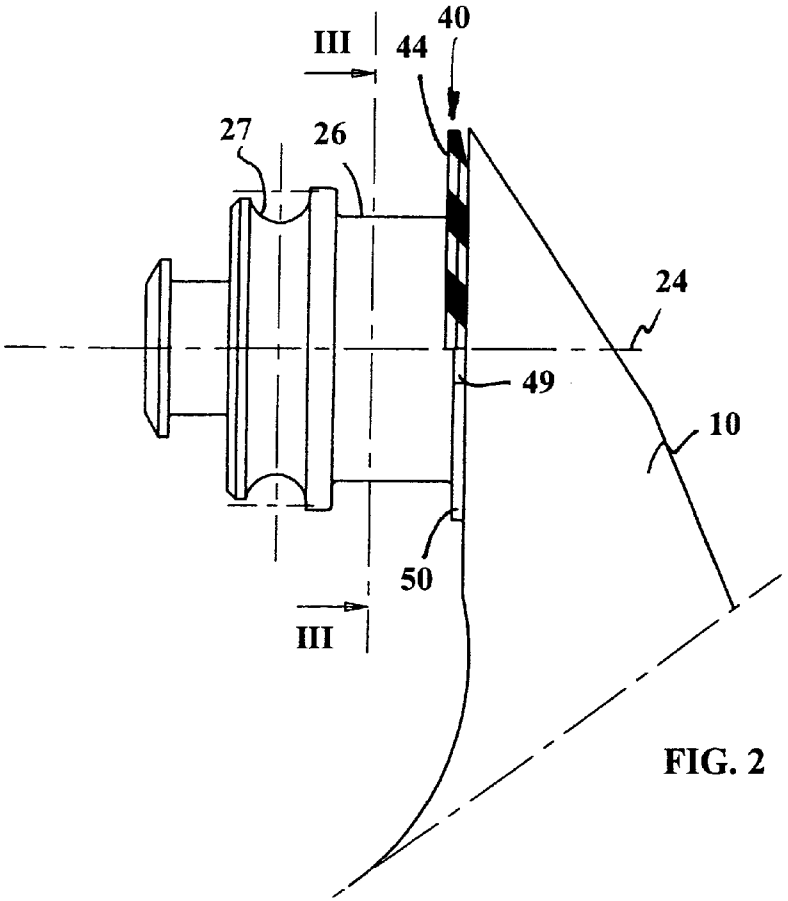
FIG. 2 shows the end of the leg in,a side view, partly in cross section.

The cylinder bearings 14 rotate along races 26 and the balls 15 rotate in roller bearing races 27 (FIG. 2). The balls preferably are larger in diameter than the cylinder bearings 14, wherein the radially extreme point of the cylinder bearings touch a line 28, that is parallel with line 24. The tail 30, of the leg 10 according to FIG. 1B, comprises a jacket surface 31, a tail tip 32 and an axially inner forwardly facing end surface 33, which is connected via surface 35 to an active axial stop surface 34 for the bearing 14. The tip 32 is formed at the intersection between the jacket surface 31 and the end surface 33. Gage inserts 37 are provided generally in the jacket surface for retaining the diameter of the hole and for counteracting erosion of the steel material of the roller cutter.

Figure 3:
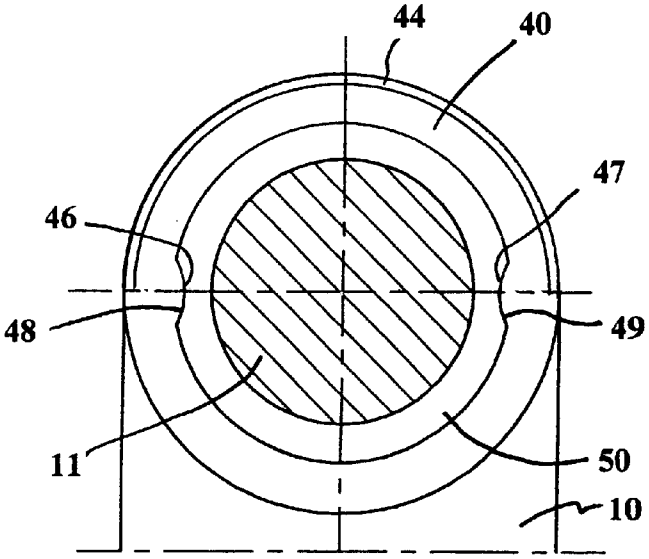
FIG. 3 shows the end of the leg partly in cross section according to line III—III in FIG. 2.
Figure 4:
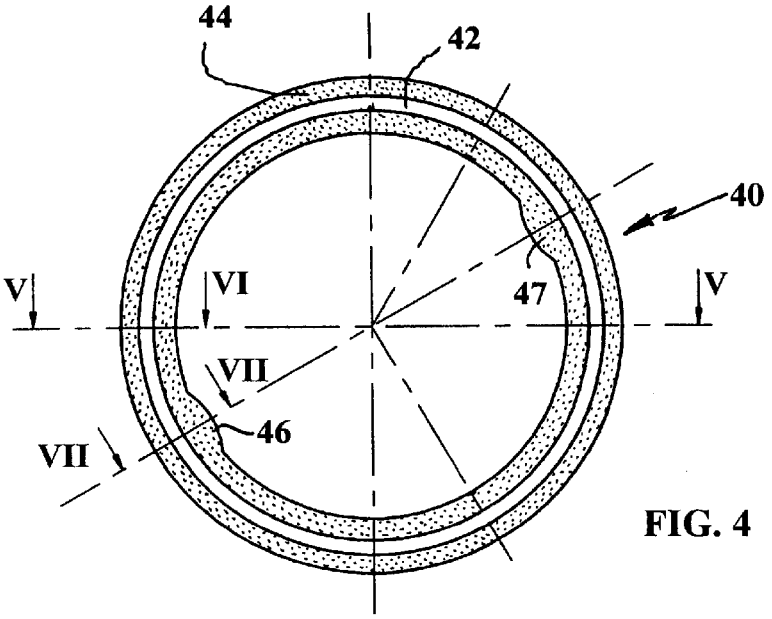
FIG. 4 shows a sealing ring according to the present invention, in plan view.
Figure 5:
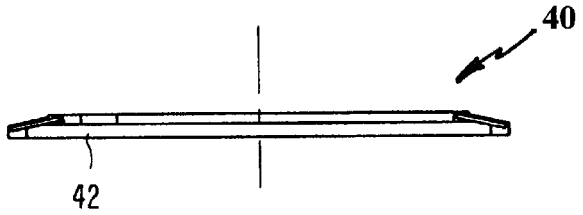
FIG. 5 shows the sealing ring in cross section according to line V—V in FIG. 4.
Figure 7:
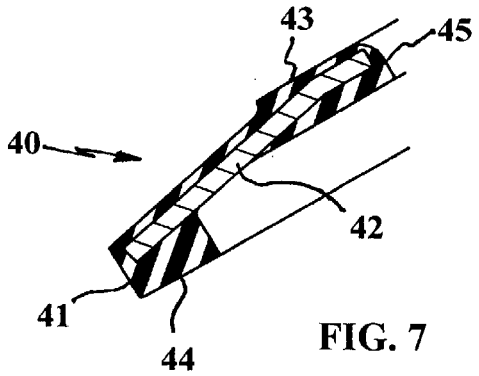
FIG. 7 shows the sealing ring in an enlarged cross section according to line VII—VII in FIG. 4.
Figure 6:
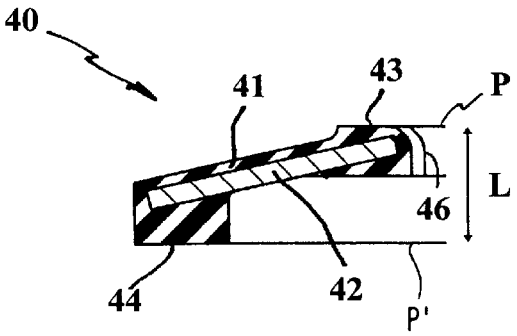
FIG. 6 shows the sealing ring in an enlarged cross section according to line VI—VI in FIG. 4.

A seal means 40 is inserted between the roller cutter 12 and the end surface 33 of the leg and is intended to prevent drill cuttings and other impurities from entering into the bearing system. Furthermore, the seal means 40 is intended to retain bearing grease in the bearing system. The seal means 40 is concentrically provided around the bearing journal 11 and is intended to slide against the roller cutter 12. The seal means 40 is more closely shown in FIGS. 4–7. The seal means consists of an annular one-piece unit consisting of a relatively flexible material 41, such as rubber, and a core or a relatively rigid material 42, such as spring steel embedded in the material. The flexible material is in non-rotational alliance with that rigid material via cutting for example. The rigid material 42 is formed as a belleville washer or a cup spring, i.e., it has the shape of a circular ring but where the plane of the inner diameter is separated from the plane of the outer diameter, for allowing rebound in the axial direction (see FIG. 5). The rigid material 42 is substantially enclosed by the flexible material 41, wherein at least two surfaces 43, 44 of the seal means are provided as abutment surfaces. The first abutment surface 43 is provided in a plane P and a second abutment surface 44 is provided in a plane P' parallel with this plane P, at a distance L. The first abutment surface 43 will be glued to the end surface 33 of the leg, radially inside the line 28. The first abutment surface 43 perpendicularly connects to a third surface 45, which can be glued to the surface 35 extending perpendicular to the first abutment surface 43 between the surfaces 33 and 34. The second abutment surface 44 is polished in order to slide easily relatively to a rearwardly facing sealing surface 36, provided on the roller cutter 12 perpendicularly to the line 28 and parallel with the end surface 33. The second abutment surface 44 is provided radially outside the line 28. The seal means 40 is provided in the axial direction at both sides of the innermost end surface of the bearing 14. That is, portions of the seal means are located on opposite side of the line S shown in FIG. 1B. The seal means 40 forms a gap with a surface 38 in the roller cutter to release grease therethrough in case the inner pressure in the bearing system becomes great. The seal means 40 and the bearing journal 11 comprise cooperating locking means in the form of diametrically opposed convex projections 46, 47 and diametrically opposed concave recesses 48, 49, respectively, provided to counteract rotation of seal means relative to the bearing journal (see FIGS. 3 and 4). The geometries of the complementary projections and recesses provide for a simple, exact and safe location of the seal means 40. The bearing journal has a collar 50 at the transition to the leg 10, which collar is defined by the perpendicular surfaces 34 and 35. The collar has a bigger diameter than the leg and has a somewhat bigger thickness in the axial direction than the, surface 45 of the seal means. The collar is provided with the circular concave recess 48, 49, the centers of curvature of which are arranged radially outside the collar. It follows that the circular projections 46, 47, have their centers of curvatures arranged radially outside the seal means. The locking means 46, 47 of the seal means 40 substantially extend in the plane P and are provided radially inside the line 28. The locking means 46–49 are provided axially forwardly of the end surface 33 of the leg.

By means of a rock drill bit and a sealing ring according to the present invention the life-span of the bearings can be extended and the mounting is simplified considerably compared to drill bits with conventional seals.

The invention is in no manner limited to the above described embodiments. For example the number of locking means may vary and the shape of the locking means may be polygonal, elliptical, or similar. In addition, the collar may be arranged with convex locking means while the seal means is provided with concave locking means.

Although the invention has been described in connection with a preferred embodiment thereof, it will be appreciated by those skilled in the art that additions, modifications, substitutions and deletions not specifically described may be made without departing from the spirit and scope of the invention as defined in the appended claims.

What is claimed:

1. A rock drill bit adapted for crushing rock comprising:

at least one leg including a bearing journal defining a longitudinal axis, the leg including an end surface extending substantially perpendicular to the longitudinal axis;

a roller cutter rotatably mounted on the bearing journal for rotation about the longitudinal axis; the roller cutter including a sealing surface disposed opposite the end surface;

bearings disposed in a space between the roller cutter and the bearing journal to facilitate rotation of the roller cutter; and a ring-shaped seal disposed between the end surface and the sealing surface for retaining grease in the space and preventing the entry of cuttings into the space, the seal arranged coaxially with the axis and comprising a one-piece annular unit extending coaxially with respect to the longitudinal axis, the seal including a first portion forming a first surface engaging the end surface, and a second portion forming a second surface engaging the sealing surface, the first and second surfaces spaced radially from one another, the sealing surface being slidable relative to the second portion as the roller cutter rotates, the seal comprising an elastic material and a relatively rigid material embedded therein, the elastic material defining the first and second portions, circumferentially spaced recesses formed in one of the leg and the first portion, and circumferentially spaced projections formed in the other of the leg and the first portion for locking the seal to the leg against rotation relative thereto.

2. The drill bit according to claim 1, wherein the first portion is glued to the leg.

3. The rock drill bit according to claim 1 wherein the leg further includes a radially outwardly facing surface intersecting the end surface, the first portion of the seal including a radially inwardly facing surface, the recesses being formed in one of the radially outwardly facing surface and the radially inwardly facing surface, and the projections being formed in the other of the radially outwardly facing surface and the radially inwardly facing surface.

4. The rock drill bit according to claim 1 wherein the first and second surfaces of the seal are disposed in respective planes extending perpendicular to the axis, the planes spaced apart in the direction of the axis.

* * * * *